US006715247B1

(12) United States Patent
Sanftleben et al.

(10) Patent No.: US 6,715,247 B1
(45) Date of Patent: Apr. 6, 2004

(54) MODULAR BRACKET FOR SUPPORTING PASSAGE CORES FOR CONCRETE STRUCTURES

(75) Inventors: Jeff Sanftleben, Canby, OR (US); Douglas E. Bowen, Tualatin, OR (US)

(73) Assignee: Bowco Industries Inc., Portland, OR (US)

( * ) Notice: Subject to any disclaimer, the term of this patent is extended or adjusted under 35 U.S.C. 154(b) by 0 days.

(21) Appl. No.: 10/256,960

(22) Filed: Sep. 27, 2002

(51) Int. Cl.[7] ..... F16L 3/08; F16L 3/22

(52) U.S. Cl. ..... 52/220.8; 52/98; 52/380; 52/592.6; 52/663; 249/39; 249/176; 249/210; 248/68.1

(58) Field of Search ..... 52/220.8, 216, 52/576, 323, 380, 660, 663, 590.2, 592.6, 98; 249/39, 176, 207, 210; 248/68.1

(56) References Cited

U.S. PATENT DOCUMENTS 2,165,905 A * 7/1939 Phillips ..... 249/39
3,523,667 A * 8/1970 Guerrero ..... 248/49
3,731,448 A * 5/1973 Leo ..... 52/592.1
3,856,246 A * 12/1974 Sinko ..... 248/68.1
4,007,941 A * 2/1977 Stancati ..... 277/606
4,075,803 A * 2/1978 Alesi, Jr. ..... 52/220.8
4,199,070 A * 4/1980 Magnussen, Jr. ..... 211/60.1
4,601,447 A * 7/1986 McFarland ..... 248/49
4,618,114 A * 10/1986 McFarland ..... 248/65
5,104,072 A * 4/1992 Kuo et al. ..... 248/68.1
5,615,850 A * 4/1997 Cloninger ..... 248/68.1
5,992,802 A * 11/1999 Campbell ..... 248/68.1
6,561,466 B1 * 5/2003 Myers et al. ..... 248/74.4

OTHER PUBLICATIONS

Product Brochure: Formex Manufacturing, Inc. "Interlocking Module Spacers".
Product Brochure: Formex Manufacturing, Inc. "Duct Terminators".

* cited by examiner

*Primary Examiner*—Brian E. Glessner
(74) *Attorney, Agent, or Firm*—Langlotz Patent Works, Inc.; Bennet K. Longlotz

(57) ABSTRACT

A support module for interconnecting to like support modules serves to support a number of core elements for encapsulation within a concrete structure. The module has a planar frame defining a first cutout and a second cutout. Each cutout has an arc shape, such that the cutouts from different modules define a circular aperture for closely receiving one of the core elements. The frame has extending portions with connection elements that connect with other support modules to securely receive the core elements. The extending portions are located about the periphery of the frame so that they are able to connect to other support modules in four orthogonal directions.

20 Claims, 3 Drawing Sheets

MODULAR BRACKET FOR SUPPORTING PASSAGE CORES FOR CONCRETE STRUCTURES

FIELD OF THE INVENTION

The invention relates to facilities cast into concrete structures, and more particularly to apparatus for forming passages in concrete walls for later passage of wires, conduits, and pipes.

BACKGROUND AND SUMMARY OF THE INVENTION

In the manufacture of concrete walls, such as those that make up underground utility vaults, it is useful to have pre-cast apertures available for penetration by pipes, conduits, wires and the like. Such apertures have been provided by positioning core elements between the forms used to cast the wall or vault, so that the cores exclude concrete from the desired locations. To provide circular apertures, cylindrical core elements are employed. The cores may have some compressibility or rim gaskets to accommodate variations in form spacing and remain flush against the form surfaces during casting, to ensure that concrete does not enter the desired voids. The cores normally include a cap, membrane, or other barrier that is readily removed or opened when passage is desired, but which seal out dirt and groundwater from the vault.

One difficulty with casting multiple cores is securing them in a desired position. One past approach is to secure them to one of the form boards. This is time consuming, can lead to irregular positioning, and damages the form boards over time. To avoid these problems, systems exist with solid panels having apertures arranged in a matrix to receive a number of cores. Each such panel has a defined number of apertures in which cores may be installed prior to casting. These are normally fastened to a form board, leading to form damage over time. In addition, a different size and shape of panel must be manufactured and stocked for each possible configuration of holes, leading to increased inventory costs. The inventory concern is only partially addressed by modular panels that employ modular strips that are assembled to form a matrix of apertures. Such existing modules are elongated members with several semicircular cutouts on one or both sides. The length of the module determines the number of apertures in each column, and the number of modules determines the number of rows in the matrix. Again, this system requires inventorying a variety of different lengths. Moreover, it generates only rectangular arrays, when other shapes may be desired (and when a rectangle large enough to encompass the desired shapes would be wasteful of material or conflict with other elements in the intended structure.)

The embodiment disclosed herein overcomes these disadvantages by providing a support module. The module interconnects with like support modules serves to support a number of core elements for encapsulation within a concrete structure. The module has a planar frame defining a first cutout and a second cutout. Each cutout has an arc shape, such that the cutouts from different modules define a circular aperture for closely receiving one of the core elements. The frame has extending portions with connection elements that connect with other support modules to securely receive the core elements. The extending portions are located about the periphery of the frame so that they are able to connect to other support modules in four orthogonal directions.

DETAILED DESCRIPTION OF A PREFERRED EMBODIMENT

Figure 1:
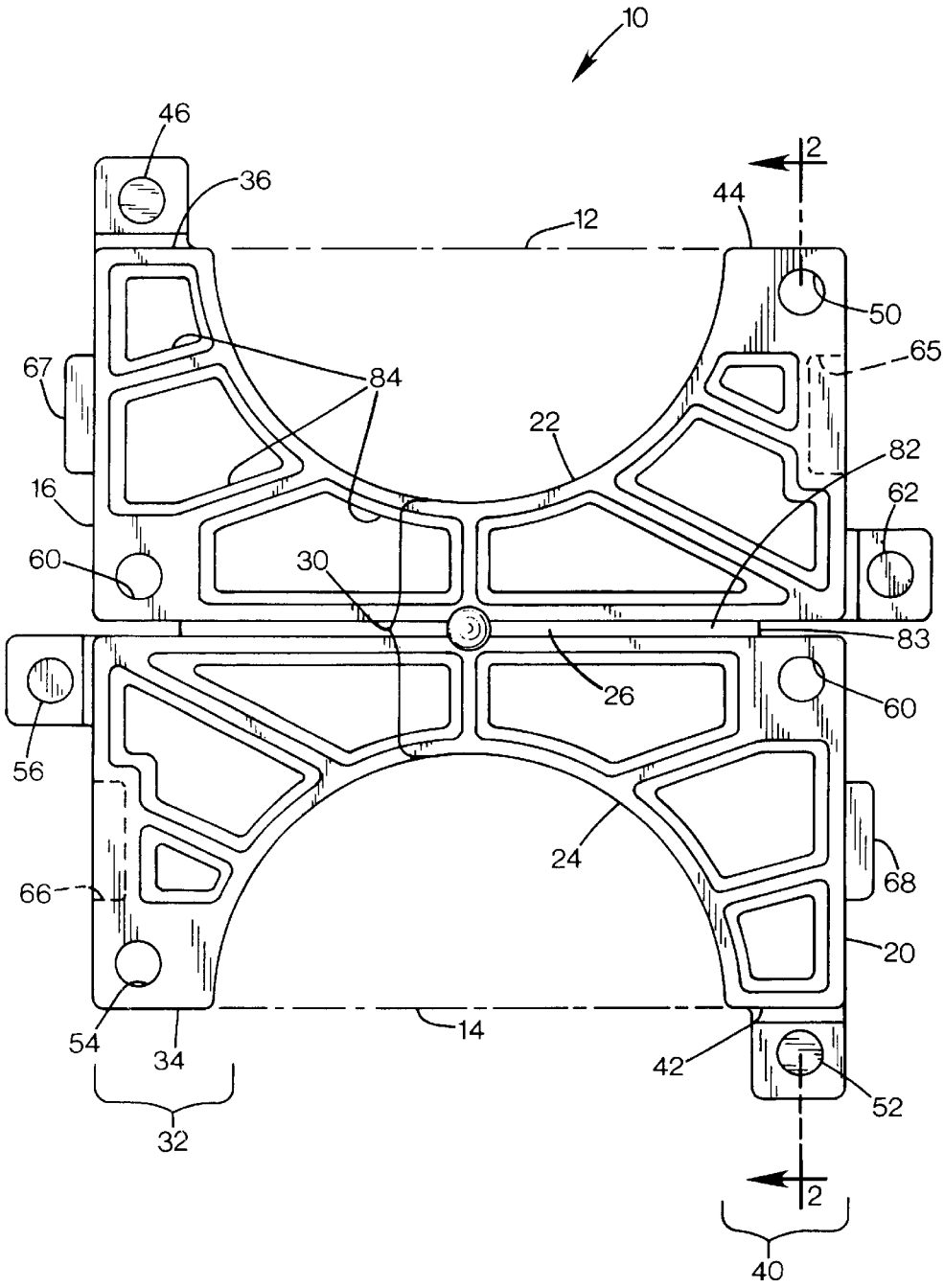
FIG. 1 is a plan view of a support structure module according to a preferred embodiment of the invention.

FIG. 1 illustrates a support structure module 10, which is preferably molded of a rigid thermoplastic such as styrene or ABS. The module is a generally flat body having a generally square shape overall. The square has an upper edge 12, opposed lower edge 14, left side edge 16, and right side edge 20. While discussed in these terms for clarity in reference to the illustration, the module need not be oriented in the manner illustrated.

An upper semicircular cutout 22 is defined in the module, and centered on the upper edge 12. The cutout has a diameter that is a major fraction of the module's nominal width as defined between the sides 16 and 20. In the preferred embodiment, the sides of the square are 6.25 inches, and the cutout diameter is 4.25 inches. The thickness is preferably 0.35 inches. All these dimensions may vary depending on the needs of the application. A lower semicircular cutout 24 is similarly defined at the lower edge 14, in a manner symmetrical about a horizontal mid-line 26 of the module with respect to the upper cutout 22.

Within the shape of the square that circumscribes it, the module has a modified "H" shape, with a cross bar 30 extending from side 16 to side 20. A left bar 32 extends along side 16 from a lower end 34 to an upper end 36. A right bar 40 extends along side 20 from a lower end 42 to an upper end 44.

The module has connector elements on all sides, so that a set of like modules may be interconnected in a matrix. The module has four female connectors and four male connectors, one of each edge. On the top edge 12, an upper male connector 46 extends from the left upper end 36 along the left side edge 16, and an upper female connector 50 is defined in end 44 along the right side edge 20. On the lower edge 14, a lower male connector 52 extends from the right lower end 42 along the right side edge 20, and an lower female connector 54 is defined in end 34 along the left side edge 16. On the left edge 16, a left male connector 56 extends from the edge just below the mid-line 26, and a left female connector 60 is defined along the left side edge 16 just above the midline. On the right side edge 20, a right male connector 62 extends from the edge just above the mid-line 26, and a right female connector 60 is defined along the right side edge 16 just below the midline. The connectors are arranged so that the module may be rotated 180 degrees within the plane of the figure, and the same form, fit, and function is provided. Each male connector button 46, 52, 56, 62 is sloped to form a ramp that tapers in an orthogonal direction away from the body of the module, in a direction perpendicular to the edge from which the connector element protrudes. In addition, pockets 65 and 66 are formed along the upper right and lower left side edges of the module at the rear surface, to accommodate tabs 67 and 68 that extend from the upper left and lower right edges. These mating tabs and pockets prevent vertical and lateral shifting of the modules when interconnected, and particularly provide that the male connectors remain biased against the female connectors to avoid unwanted disconnection.

Figure 2:
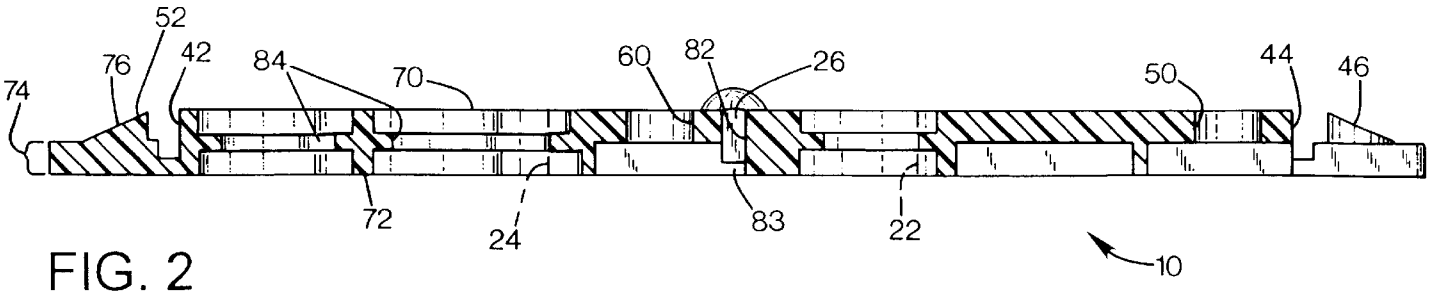
FIG. 2 is a sectional side view of the module of FIG. 1, taken along line 2—2.

As shown in FIG. 2, the module 10 has a front face 70 and a rear face 72, although these are not absolute descriptions, but merely used for reference and clarity. Each male connector comprises a half thickness portion 74 of the module body that is flush with the front surface, with a cylindrical button 76 extending from the portion 74. The female portions are circular apertures defined in half thickness portions that are flush with the rear face 72. The male buttons and female apertures are sized for a close fit, so that when adjacent modules are interlinked, the half thickness portion of the male connector resides in the recess above the female connector, and the button occupies the aperture. The male connectors protrude beyond the periphery of the square that nominally defines the module, so that they overlap onto the female connectors within the square of the adjacent module.

The module defines a groove or channel 82 along the midline 26, so that a remaining web 83 connects the two halves of the module. This facilitates breaking the module in two parts, for the upper and lower rows of a matrix, as will be discussed below. For material conservation, the module defines numerous openings 84 that provide a truss-like appearance.

Figure 3:
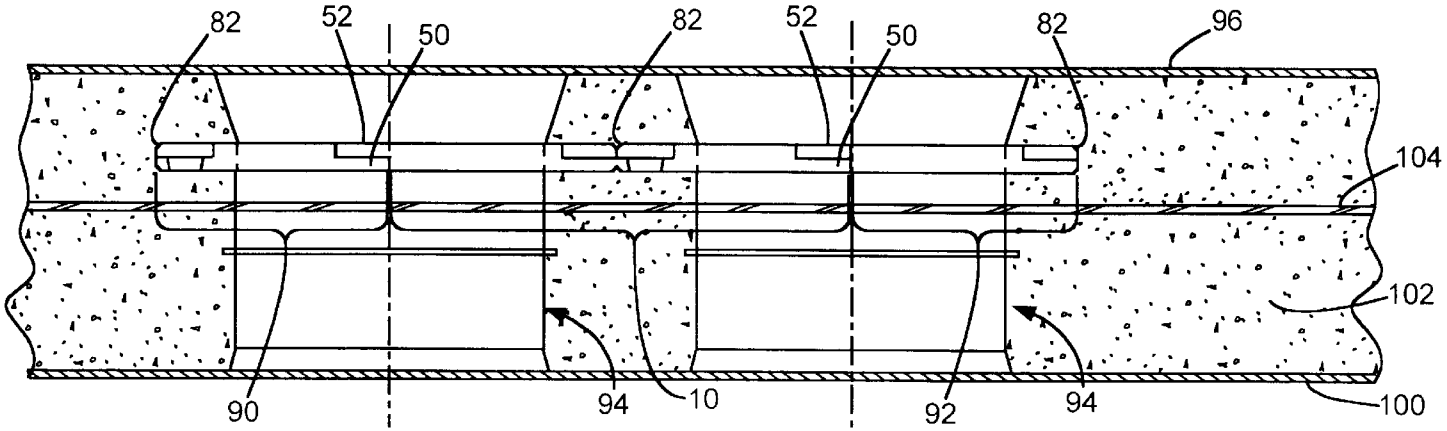
FIG. 3 is a sectional side view of a wall structure according to the preferred embodiment of the invention.

FIG. 3 shows a cross section of a concrete wall including several modules 10 in a sample arrangement. A whole module 10, shown in side edge view, is connected to a first half module 90 and a second half module 92. The half modules are broken from a single whole module, and their groove edges 82 face away from the central module. The male connector 52 of the center module is connected to the female aperture 50 of the first half module, as is the male connector 46 (not visible) of the first half module connected to the female connector 54 (not visible) of the whole module 10. The second half module is similarly connected to the whole module. A larger array can be created by using additional whole modules between the half modules.

Together, the modules 10, 90, and 92 define two circular apertures that closely receive cylindrical duct or core elements 94. The cores extend between the inner surfaces of form boards 96, 100 that are spaced apart to provide a space to contain poured concrete 102 that hardens to form the wall. A grid of reinforcing bar (rebar) 104 is positioned between the forms, and the modules are secured to the grid before concrete is poured to ensure that the cores are cast in the desired position. The cores exclude concrete from the volumes they occupy, so that cables, conduits, pipes and the like may be subsequently passed through the wall without drilling or sawing of concrete or rebar.

Figure 4:
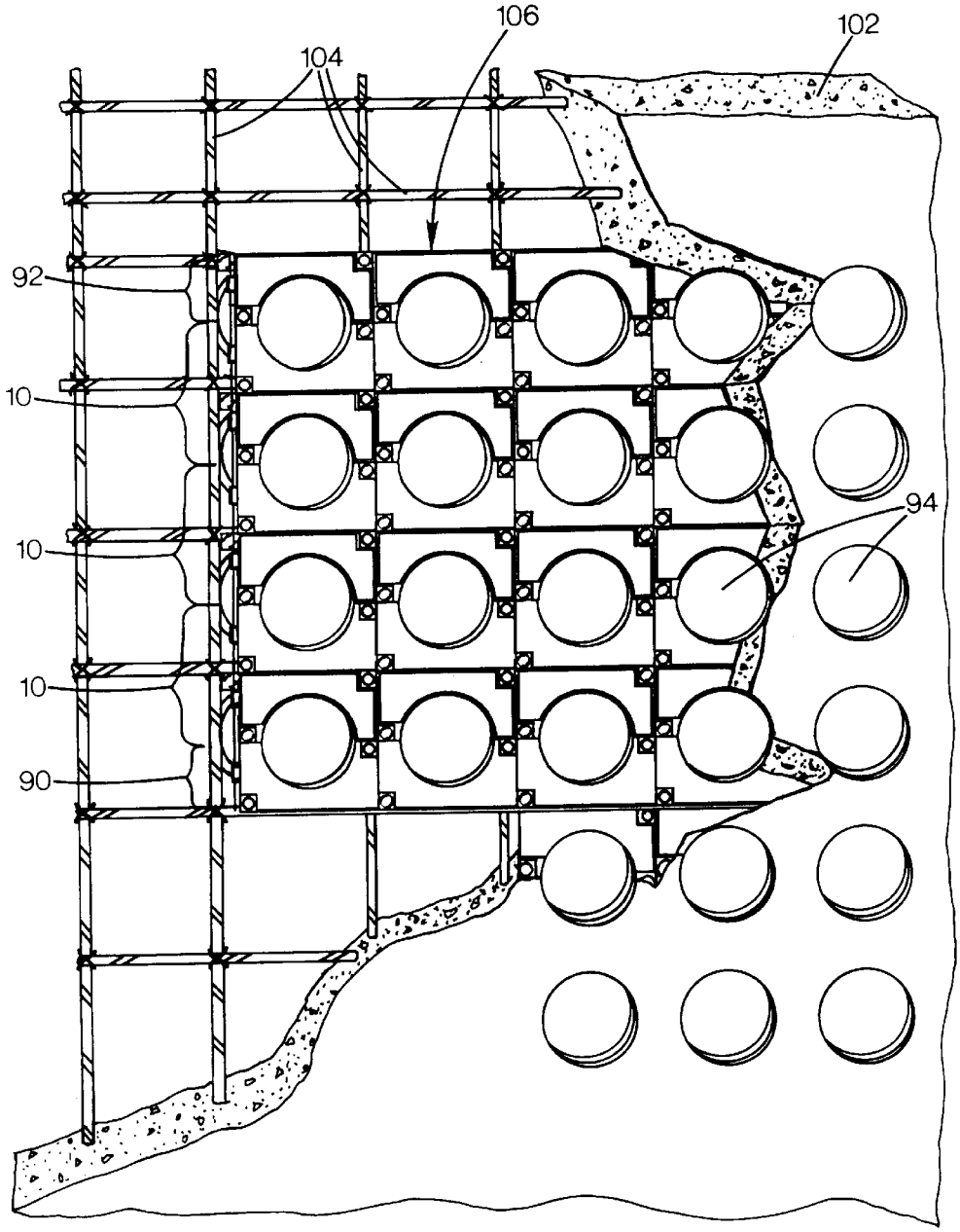
FIG. 4 is a fragmentary view of a wall structure according to the preferred embodiment of the invention.

A grid or matrix 106 of modules 10 is shown in FIG. 4, with a concrete vault wall 102 cut away to show the grid and rebar 104. The cores 92 are exposed at each surface, and include membranes or covers that prevent dirt and water outside on one side of the wall from passing through to the other prior to penetration by a conduit of wire. The rebar 104 is arranged in a grid with spacing established to fit one core within each defined square grid space. Thus, for pre-welded rebar grid, the modules should be formed with the same dimensions to avoid interference between cores and rebar. In alternative installations, the rebar grid may have an opening sized and shaped to receive the matrix of modules, with the rebar at the periphery supporting and locating the matrix, with no rebar passing between the cores.

The grid 106 illustrates one example of the many flexible alternative shapes that may be formed with the modules. It has some rows and columns with fewer apertures for cores than others. The lower left corner has no modules. This may be useful to reduce waste of modules, to avoid needless and structurally weakening apertures, and to provide a space for other special large apertures. For instance, a wall with a large conduit, window, door, lifting hook or other aperture or element several times larger than the standard modules may have a frame of modules and cores about the large central aperture. The flexible arrangement allows modules to be omitted from peripheral and central portions of the grid, to form any shape. The only limitation on shape is that each aperture be orthogonally adjacent to at least one other aperture.

While the disclosure is made in terms of preferred and alternative embodiments, the invention is not intended to be so limited.

What is claimed is:

1. An support module for interconnecting to like support modules for supporting a plurality of core elements for encapsulation within a concrete structure comprising:

a planar frame defining a first cutout and a second cutout;

each cutout having an arc shape such that a plurality of cutouts of different modules define a circular aperture for closely receiving one of the core elements;

the frame having extending portions having connection elements operable to connect with other support modules to securely receive the core elements;

the extending portions located about the periphery of the frame such that they are operable to connect to other support modules in four orthogonal directions;

the module defining a groove parallel to a cross bar, such that the module may readily be broken in half with each half portion including a cutout.

2. The module of claim 1 wherein the cutouts of the module have a total angular arc size of 360 degrees.

3. The module of claim 1 wherein the module defines semicircular cutouts opening in opposing directions.

4. The module of claim 1 wherein the module has an "H" shape, with parallel side portions perpendicular to the cross bar, each side portion having extending portions, each cutout defined between the extending portions of one side portion and the extending portion of the other side portion.

5. The module of claim 4 wherein the connection elements include a vertical interconnect on at least some of the extending portions, and an opposed pair of lateral interconnects, each at an intermediate position of one of the side portions.

6. The module of claim 1 wherein the module is rotationally symmetrical, such that it can be rotated 180 degrees.

7. The support module of claim 1 wherein the module has a generally rectangular body, and wherein the extending portions extend beyond the periphery of the body, such that the extending portions are adapted to overlap the body of an adjacent interconnected module.

8. The support module of claim 1 wherein the module has two half portions joined at the groove, and wherein each half portion is a rectangle with three straight side edges, and a fourth side edge defining a semi-circular cutout.

9. A core element support structure for supporting core elements for encapsulation within a concrete structure comprising:

a plurality of identical support modules each defining a medial break line;

the modules defining a plurality of circular apertures;

each aperture defined by at least two modules;

the modules being interconnected in two orthogonal directions;

at least a peripheral aperture defined in part by an edge module portion; and each of the edge module portions being a half of a support module separated at the break line.

10. The structure of claim 9 wherein the apertures are arranged in a matrix of rows and columns.

11. The structure of claim 10 wherein at least one of the rows has a different number of apertures from at least another of the rows.

12. The structure of claim 10 wherein at least one of the columns has a different number of apertures from at least another of the columns.

13. The structure of claim 9 wherein each module defines semicircular cutouts opening in opposing directions.

14. The structure of claim 9 wherein each module has an "H" shape, with a cross bar portion and parallel side portions perpendicular to the cross bar, each side portion having extending portions, each cutout defined between the extending portions of one side portion and the extending portion of the other side portion.

15. The structure of claim 14 wherein the connection elements include a vertical interconnect on at least some of the extending portions, and an opposed pair of lateral interconnects, each at an intermediate position of one of the side portions.

16. The structure of claim 9 wherein each module is rotationally symmetrical, such that it can be rotated 180 degrees.

17. The structure of claim 16 wherein the module is rotationally symmetrical about three orthogonal axes.

18. The core element support structure of claim 9 wherein each of the medial break lines allows, such that each support module may be broken into separate halves, and wherein the edge module portion is in the form of one of the separate halves, such that all the support modules and edge module portions may be provided by a common supply of identical modules.

19. A concrete structure comprising:

a core element support structure;

the support structure comprising a plurality of identical support modules defining a plurality of circular apertures;

each aperture defined by at least two modules;

the support structure having a periphery having straight orthogonal edges;

the modules being interconnected in two orthogonal directions;

at least some of the apertures being occupied by cylindrical core elements;

a concrete body having opposed major surfaces, and encapsulating the support structure and core elements; and the core elements defining voids in the concrete body that extend between the major surfaces.

20. The structure of claim 19 wherein the support structure is spaced apart from both major surfaces, such that it is fully encapsulated.

* * * * *